US005357911A

United States Patent [19]

Lindblad

[11] Patent Number: 5,357,911

[45] **Date of Patent: * Oct. 25, 1994**

[54] FOUR-STROKE RADIAL-PISTON ENGINE

[75] Inventor: Karl-Erik Lindblad, Alingsås, Sweden

[73] Assignee: Kesol Production AB, Alingsas, Sweden

[ * ] Notice: The portion of the term of this patent subsequent to Apr. 8, 2092 has been disclaimed.

[21] Appl. No.: 678,966

[22] PCT Filed: Oct. 24, 1989

[86] PCT No.: PCT/SE89/00582

§ 371 Date: Jun. 21, 1991

§ 102(e) Date: Jun. 21, 1991

[87] PCT Pub. No.: WO90/04709

PCT Pub. Date: May 3, 1990

[30] Foreign Application Priority Data

Oct. 24, 1988 [SE] Sweden ..... 8803791

[51] Int. Cl.[5] ..... F02B 57/00; F02B 75/22

[52] U.S. Cl. ..... 123/44 B; 123/44 E; 123/54.3

[58] Field of Search ..... 123/44 B, 44 E, 55 AA

[56] References Cited

U.S. PATENT DOCUMENTS

| | | | |
|---|---|---|---|
| 936,036 | 10/1909 | Reimers | 123/44 B |
| 1,276,351 | 8/1918 | Halsey | 123/44 B |
| 1,324,408 | 12/1919 | Ragot | 123/44 B |
| 1,526,610 | 2/1925 | Sellberg | 123/44 B |
| 1,827,094 | 10/1931 | McCann | 123/44 E |
| 1,840,625 | 1/1932 | Helm et al. | 123/44 E |
| 2,651,295 | 9/1953 | Pechoux | 123/44 B |
| 2,894,496 | 7/1959 | Townsend | 123/44 E |
| 3,688,751 | 9/1972 | Sahagian | 123/44 B |
| 3,874,348 | 4/1975 | Townsend | 123/44 B |
| 4,051,819 | 10/1977 | Henström | 123/44 B |
| 4,128,084 | 12/1978 | Sutherland | 123/55 A |
| 4,653,438 | 3/1987 | Russell | 123/44 B |
| 4,974,553 | 12/1990 | Murray et al. | 123/44 B |
| 5,023,536 | 5/1977 | Townsend | 123/44 E |

OTHER PUBLICATIONS

International Search Report-PCT/SE 89/00582, Completion date: Dec. 28, 1989.

*Primary Examiner*—E. Rollins Cross
*Assistant Examiner*—Thomas N. Moulis
*Attorney, Agent, or Firm*—Ernest A. Beutler

[57] ABSTRACT

On the rotary drive shaft of a four stroke engine is non-rotationally mounted a hub supporting four cylinders wherein pistons are arranged for reciprocal movement radially towards the hub. The hub is providing with a combustion chamber having common inlets and outlets formed in a valve ring rotating together with the hub and sealingly abutting against a stationary port ring having intake and exhaust ports communicating with inlet and outlet channels arranged alternatingly to assume a position in registry with the inlets and outlets associated with the respective combustion chamber. One spark plug for each combustion chamber is arranged to rotate with the hub, with the spark plug electrode end projecting into the associated combustion chamber opposite the common valve ring inlets and outlets.

10 Claims, 7 Drawing Sheets

FOUR-STROKE RADIAL-PISTON ENGINE

Figure 1:
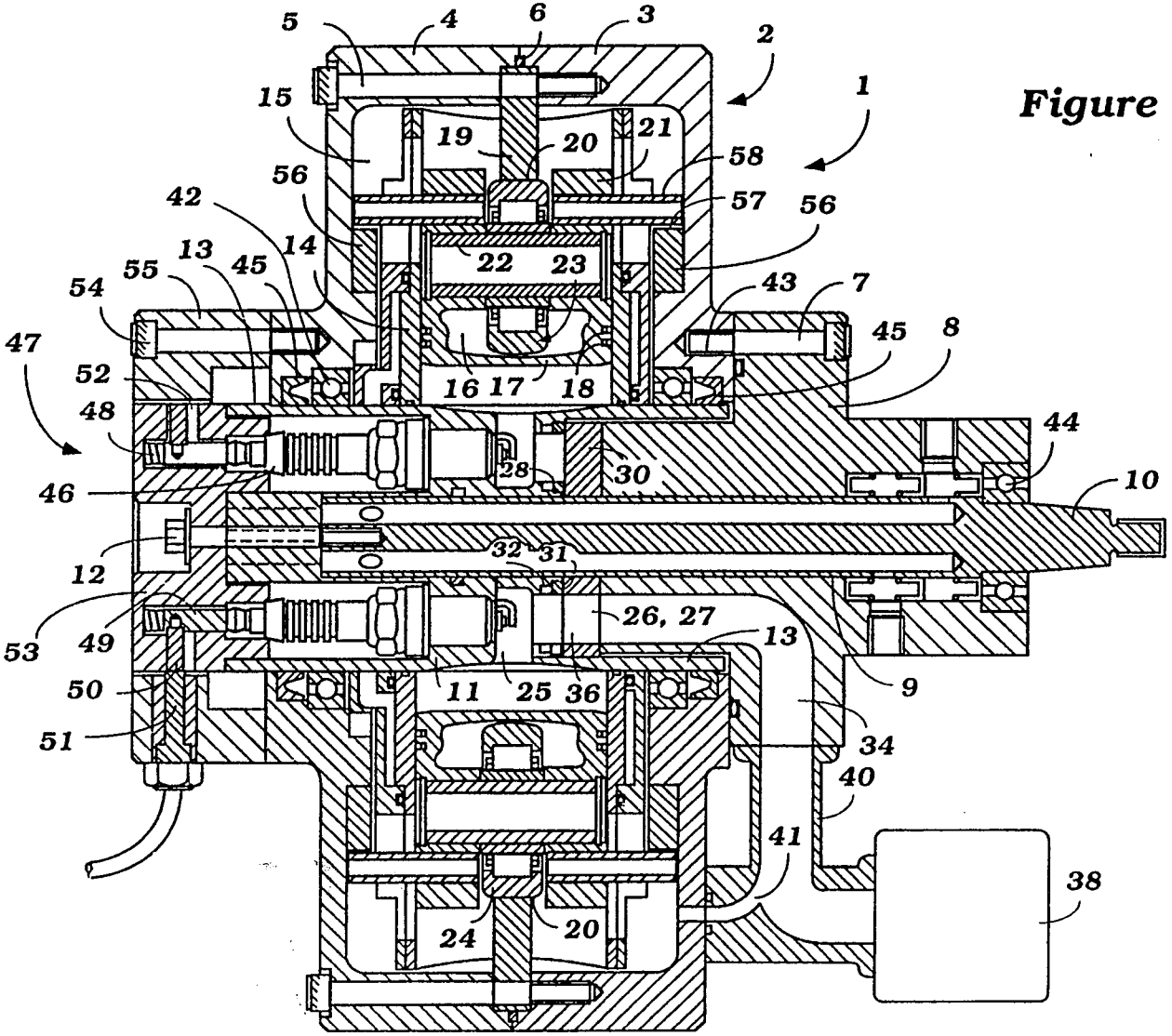

The present invention concerns a four-stroke radial-piston engine comprising a stationary housing, a drive shaft which is rotationally mounted substantially centrally inside said housing and which supports a hub rotating therewith, at least two radially projecting cylinders which are mounted on the hub to rotate therewith, said cylinders being positioned inside a circumferentially extending chamber in said housing and each having a piston which is mounted for radial reciprocating movement inside its associated cylinder, the piston heads of said piston facing radially inwards towards the hub, a circumferentially extending cam member mounted inside the housing in alignment with the pistons adjacent the radially outwardly extending piston ends and having a cam face facing said pistons, against which cam face abut bearing means mounted on each piston in order to impart a radial movement to said pistons in the direction towards the hub upon rotation of the rotary unit formed by the pistons, the cylinders, the hub, and the drive shaft relatively to the stationary housing, a combustion chamber formed in said hub essentially in alignment with the head of each one of said pistons, which combustion chamber has valve-operated inlets and outlets for intake and exhaustion, respectively, of a combustible fuel-air mixture and combusted exhaust gases, whereby said pistons are imparted a radial motion away from the hub in response to the compression-induced increase of pressure and the centrifugal force.

An internal combustion engine of the above type is disclosed and described in U.S. Pat. No. 2,894,496. In this prior art internal combustion engine the drive shaft and the hub together form a hollow rotor in which is received a stationary, housing-mounted shaft. The shaft is formed with an intake channel communicating at one of its ends with a radial intake port and at its opposite end with a carburetter for supply of a combustible fuel-air mixture. The stationary shaft is also formed with an outlet channel communicating at one of its ends with a radial exhaust port and at its opposite end with an exhaust pipe for removal of exhaust gases. The radial intake and exhaust ports in the stationary shaft communicate with the combustion chamber inlets and outlets.

A chamber is also formed in the stationary shaft, housing a spark plug the electrode end of which opens into an essentially radially extending port formed in the shaft. This port may be shifted to a position radially opposite the combustion chamber inlets and outlets so as to ignite the combustible fuel-air mixture sequentially in all combustion chambers by means of sparks emitted by the single spark plug.

The provision of one central, stationary shaft having radial intake, exhaust, and spark plug ports which communicate with radial inlets and outlets in the rotor rotating about the shaft, causes considerable wear and thus leakage problems in the shaft and rotor interfaces in the areas around the ports as well as around the inlets and outlets. When the wear and leakage have reached an excess level the stationary shaft or the rotor or both must be exchanged or reconditioned.

The position of one single spark plug inside the stationary and gradually increasingly hot shaft causes maintenance and heat load problems, because the spark plug is well encased inside the shaft and in order to replace it, the shaft must be completely dismantled from the stationary housing. In addition, the spark plug is exposed to considerable wear, since in accordance with the embodiment illustrated and described in the prior art patent specification, comprising four cylinders, it must emit an ignition spark four times per revolution of the rotary unit formed by the piston, the cylinders, and the rotor.

The purpose of the subject invention is to reduce as far as possible the problems outlined in the aforegoing in a simple and efficient manner in an internal combustion engine of the kind defined initially and at the same time disclose an engine of this type comprising a minimum of movable and therefore wear-exposed parts.

Primarily, this purpose is achieved in that the inlets and the outlets to and from, respectively, each combustion chamber are common and are formed in a valve ring which rotates together with the hub and which is essentially concentric therewith, said valve ring sealingly abutting against a stationary port ring which is essentially concentric with the valve ring and which is connected to the housing, said port ring being formed with axial intake and exhaust ports communicating with inlet and outlet ducts, said axial intake and exhaust ports alternatingly, assuming, upon rotation of said rotary unit relatively to the housing, a position in alignment with that inlet and outlet formed in the valve ring that is associated with the respective combustion chamber, and in that one spark plug is provided for each combustion chamber, said spark plug being screwed essentially axially into the hub and rotating together with the latter, so that by means of their electrode ends the spark plugs project into their associated one of the combustion chambers essentially in alignment with the common inlet and outlet in the valve ring.

The invention will be described in closer detail in the following with reference to the accompanying drawings, illustrating an embodiment thereof which is particularly preferred at the moment. In the drawings, FIG. 1 is a longitudinal sectional view through the radial-piston engine in accordance with the invention.

Figure 2A:
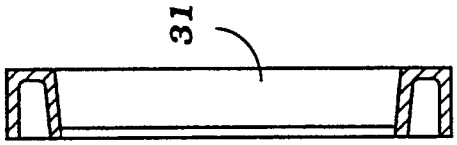
Figure 2:
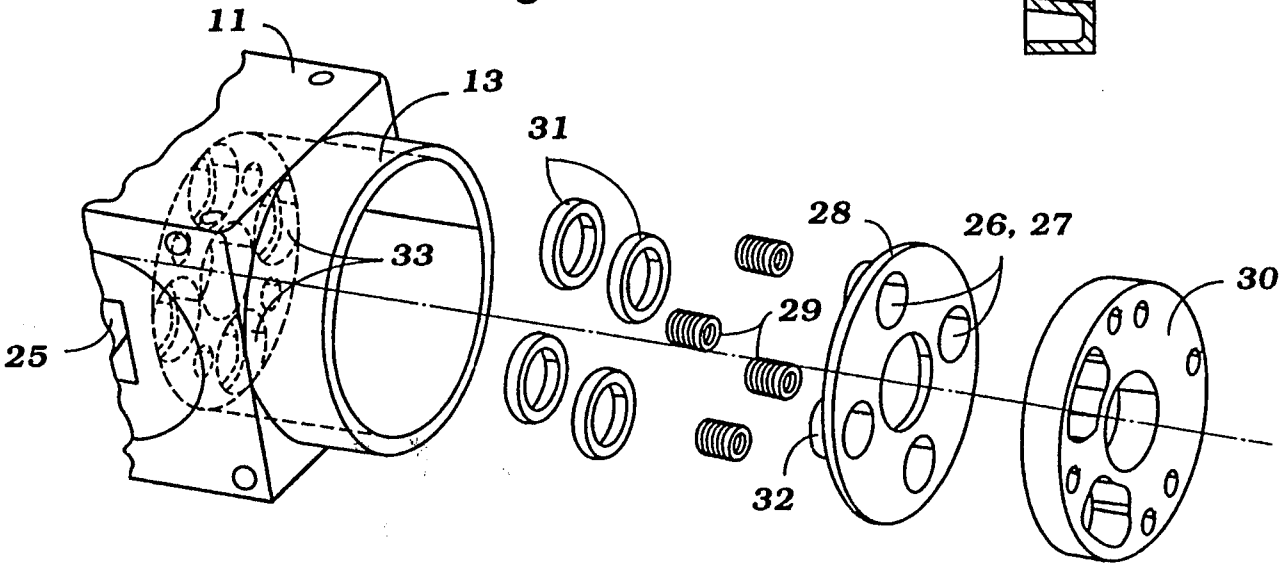
Figure 3B:
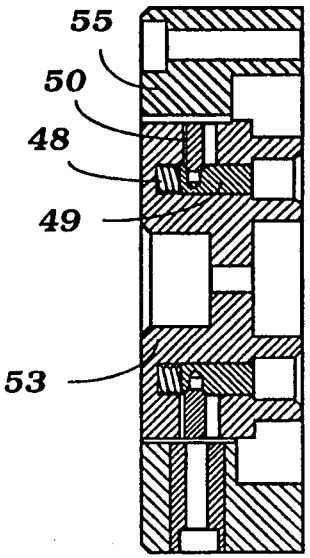
Figure 3A:
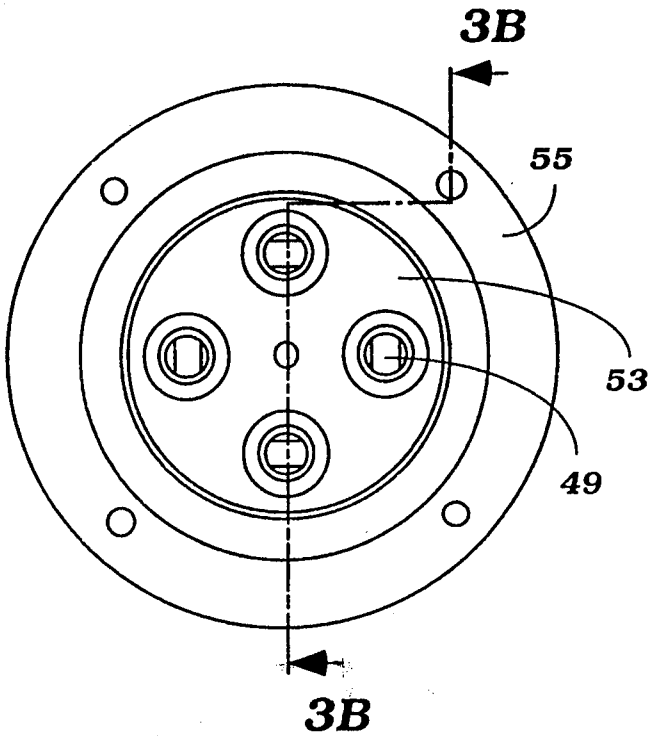

FIG. 2 is a perspective view showing the various components incorporated in the valve system of FIG. 1, FIGS. 3A and 3B are respectively a front view and a sectional view along line 3—3 in FIG. 3A of details of an ignition system incorporated in the engine in accordance with FIG. 1, and FIGS. 4A–7B are transverse and lengthwise sectional views showing the positions of the various components during the four different cycles of the engine in accordance with FIG. 1.

The engine illustrated in the drawings is a four-stroke internal combustion engine pertaining to the group of multiple cylinder radial-piston engines. The internal combustion engine is indicated generally by numeral reference 1 and it comprises a stationary, essentially rotationally symmetrical or annular housing 2. The stationary housing 2 is made from a suitable material, such as cast iron or light metal and it consist of two halves or housing parts 3 and 4, which are held together by means of bolts 5 spaced circumferentially adjacent the external periphery of the housing. To seal off the two housing ports 3, 4 from one another a peripheral seal 6, such as an O-ring, preferably is provided.

On one of the parts of the stationary housing 2, in accordance with the shown embodiment housing part 3, is by means of bolts 7 securely anchored a connecting collar 8 having a central through-opening 9 for reception therein of a drive shaft 10 which is mounted essentially in the centre of the housing 2 for rotary motion therein. A hub 11 which rotates together with the drive shaft 10 is secured on the drive shaft by means of a centre bolt 12 and is formed with axially extending, sleeve-like extensions.

The rotary unit formed by the drive shaft 10, the hub 11, the cylinders 14, and the pistons 16 is rotationally mounted inside the stationary housing 2 and in the connecting collar 8 by means of roller bearings 42, 43, 44, two of said bearing, viz. bearings 42, 43, being positioned between the sleeve-like extensions 13 of the hub 11 and the stationary housing 2 whereas the third bearing 44 is positioned between the drive shaft 10 and the connecting collar 8 adjacent the free projecting end of the shaft 10 to which end a power take-off means may be connected. The bearings 42, 43 may be provided with suitable seal rings 45 positioned axially externally thereof.

Radially projecting cylinders 14, of which four are provided in accordance with the embodiment illustrated in the drawings, are non-rotationally mounted on the hub 11 so as to rotate together with the latter. All cylinders 14 are positioned inside a circumferentially extending chamber 15 in the stationary housing 2, i.e. a chamber defined by housing parts 3 and 4. Each cylinder 14 receives its associated piston 16 for reciprocating movement radially therein, said pistons 16 being of an essentially conventional configuration including piston heads 17 and sealing rings 18, the piston heads facing radially inwards, towards the hub 11.

A circumferentially extending cam member 19 the cam face 20 of which faces the pistons 16 is mounted inside the stationary housing 2 opposite the radially outwardly projecting piston ends 21. More specifically, the circumferential cam member 19 is inserted in recesses formed in opposite faces in the housing parts 3 and 4 with the cam member secured in position by means of the same bolts 5 as those which hold the housing parts 3 and 4 together. In accordance with the illustrated embodiment which concerns a four-cylinder internal combustion engine the cam face 20, as indicated e.g. in FIG. 4A, is essentially of elliptical configuration. However, the configuration of the cam surface may vary in dependence of the number of cylinders used.

Via a piston bolt 22, each piston 16 supports a bearing 23, which in accordance with the illustrated embodiment is a cylindrical roller bearing the outer ring 24 of which rolls in abutment against the cam face 20 in order to impart a radial motion to the pistons 16 in a direction towards the hub 11, when the rotary unit formed by the pistons 16, the cylinders 14, the hub 11, and the drive shaft 10 rotates relatively to the stationary housing 2.

In the hub 11, essentially opposite the heads 17 of the respective pistons 16, is formed an essentially radially inwardly directed trough-like combustion chamber 25 having axially directed inlets and outlets 26 and 27, respectively for intake of a combustion fuel-air mixture and exhaust of exhaust gases, respectively. In this manner, the pistons 16 are imparted a radial movement in the direction away from the hub 11 in response to the pressure increase resulting from the combustion and the centrifugal force acting on the pistons.

More precisely, the inlets and outlets 26, 27, leading to and from, respectively, each combustion chamber 25 are common and they are formed axially in a valve ring 28 which rotates together with the hub 11 and which is essentially concentric with the latter, see particularly FIG. 2. The valve ring 28 abuts flatly and by means of compression springs 29 it is yieldingly pressed into sealing abutment against a port ring 30 and it supports sealing rings 31 around its inlets and outlets 26 and 27, respectively. In accordance with the embodiment shown the inlets and outlets 26, 27 in the valve ring 28 are prolonged axially in the form of sleeves 32, which extend outwardly from the valve ring 28. The sleeves 32 support the sealing rings 31 and project into corresponding recesses 33 formed in the hub 11 to ensure securement and displacement of the valve ring.

The port ring 30 is essentially concentric with the valve ring 28 and it is rigidly connected to the stationary housing 2. More precisely, by means of bolts, not shown, it is mounted on the inner end of the connection collar 8 which is turned towards the combustion chambers 25. The port ring 30 is formed with axial intake and exhaust ports 36 and 37, respectively, communicating with inlet and outlet ducts 34 and 35, respectively, in the connection collar 8. The intake and exhaust ports 36, 37 are arranged, upon rotation of the rotary units 10, 11, 14 and 16 relatively to the stationary housing 2, alternatingly to assume a position in registry with the inlets and outlets 26 and 27 formed in the valve ring 28 and associated with their respective combustion chamber 25.

Figure 7B:
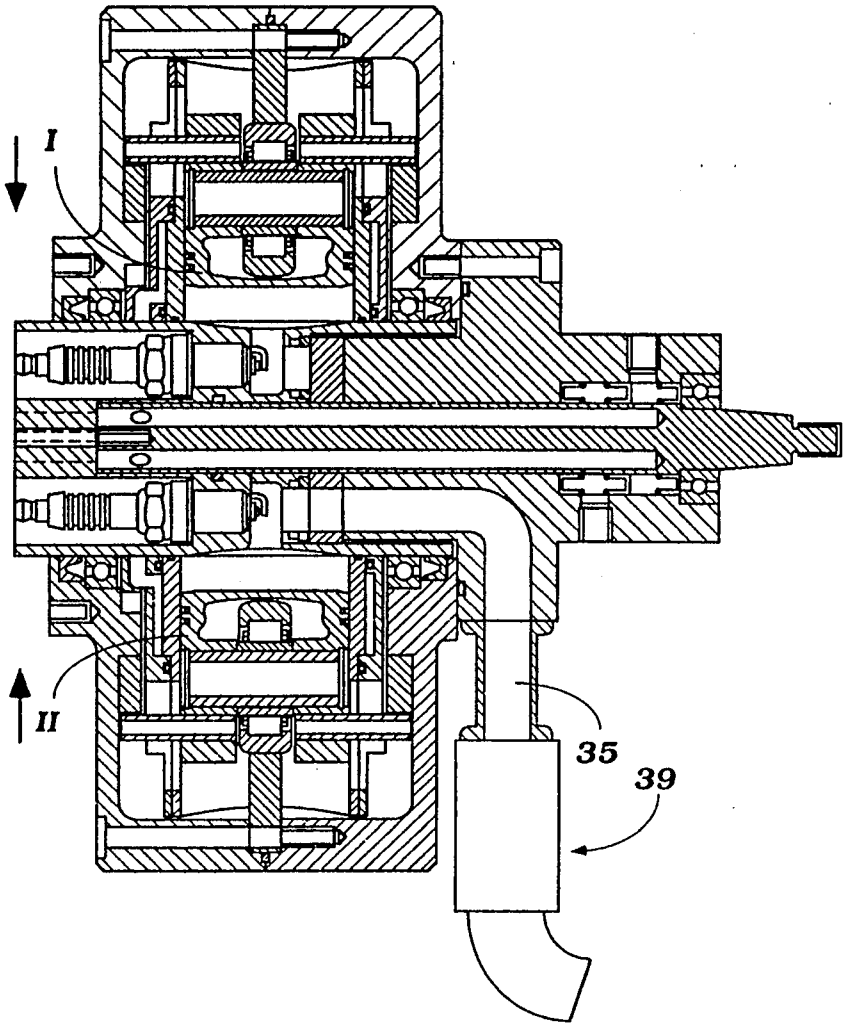

The inlet and outlet ducts 34 and 35, respectively, formed in the connection collar 8 debouch at one of their ends axially opposite the intake and exhaust ports 36 and 37, respectively, in the port ring 30 and at their opposite ends they are connected respectively to an intake system, such as a carburetter 38 or an injection system, see FIG. 1, and to an exhaust system 39, see FIG. 7B.

Intermediate the said opposite end of the inlet channel 34 and the carburetter 38 or the injection system, is an inlet pipe 40 into which debouches a channel 41 which communicates with the circumferential chamber 15 of the stationary housing 2 for the purpose of generating a negative pressure inside the chamber 15 so as to suck out any blow-by exhaust gases and, at least during conditions of low rotational speed of the engine, facilitate the radial movement outwards of the pistons 16.

For its operation, the radial-piston engine in accordance with the invention is also provided with one spark plug 46 for each combustion chamber 25, i.e. four spark plugs in accordance with the embodiment illustrated. These spark plugs are screwed essentially axially into the hub 11 at the end remote from the valve ring 28 and thus they rotate together with the hub. The electrode end of each spark plug 46 consequently projects into the associated one of the combustion chambers 25 essentially opposite the common intake and outlet 26 and 27 in the valve ring 28.

At their connective ends the spark plugs 46 are associated with an ignition distributor, generally designated by reference 47. The latter comprises electrodes 49 which are arranged to rotate together with the rotary unit 10, 11, 14, 16 and which are spring actuated by means of helical compression springs 48 into engagement with their respective one of the connective spark plug ends. Each electrode has a radially projecting contact 50 which is fastened to its associated electrode, preferably by screwing, and the contacts are arranged to sequentially move past a stationary electrode 51 which in turn is coupled to a source of ignition current, not shown in detail. Preferably, the rotating electrodes 49 and their associated contacts are disposed in recesses 52 in a hub-like holder 53 which is secured to the drive shaft 10 by means of the earlier mentioned centre bolt 10. The stationary electrode 51 is preferably arranged radially in an annular fastener 55 which is secured to the housing 2 by means of bolts 54.

To urge the pistons 16 radially outwards, at least when the internal combustion engines is started and/or operates at low rotational speeds, two circumferentially extending return can members 56 are provided in accordance with the embodiment illustrated, said return cam members being positioned one on either side of the pistons 16 and radially interiorly of the cam members 19. The circumferentially extending cam members 56 have one radially inwardly facing cam face 57 each, with a configuration essentially matching that of cam face 20 on cam member 19. Two return pins 58 projecting in opposite axial directions on each piston 16 are arranged to be moved into abutment against the cam surfaces 57 of the return cam members 56 in order to, as previously mentioned, urge the pistons radially outwards while preventing them from assuming an oblique position inside their associated one of the cylinders 14.

For the sake of completeness it should be mentioned that the radial-piston engine in accordance with the invention is fitted with a water cooling system and a lubricating system but since these systems form no part of the invention as such they are not described further herein.

It should also be mentioned that the radial-piston engine comprises four cylinders but there is nothing to prevent this number to be reduced to two or increased to perhaps six or more cylinders.

The mode of operation of the radial-piston engine described in the aforegoing will be described in the following with reference to FIGS. 4A–7B, and to illustrate the four-cycle sequence two of the pistons 16, designated I and II, have been chosen for the sake of simplicity.

Figure 4B:
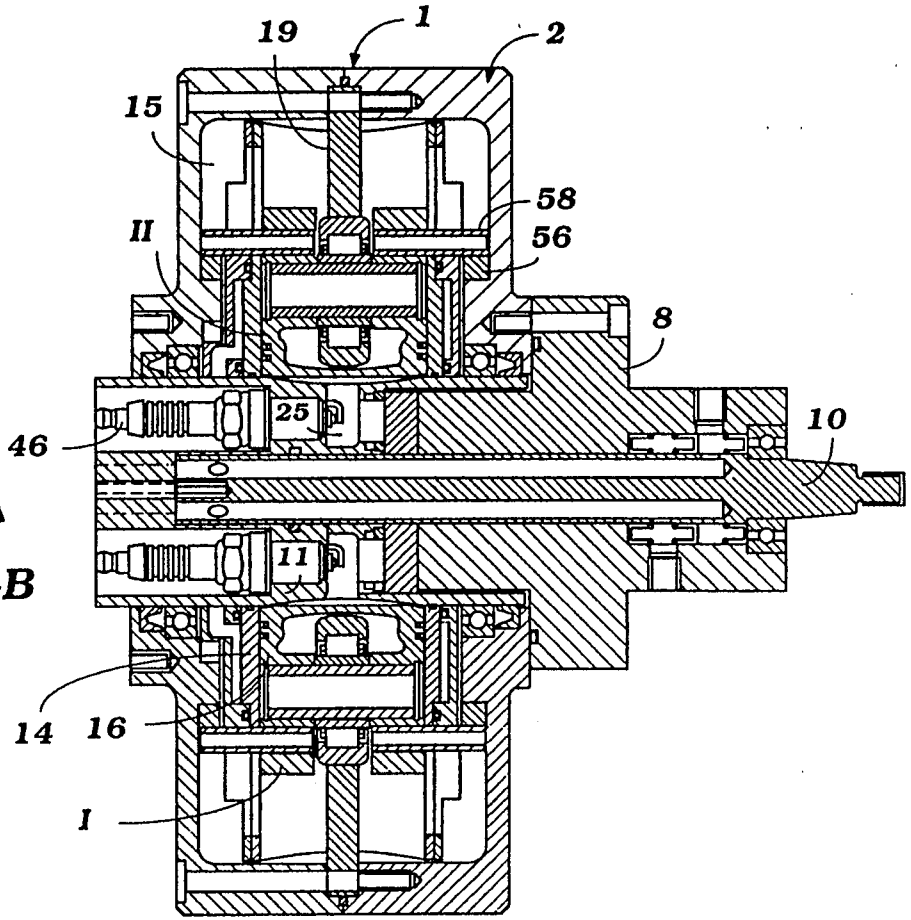
Figure 4A:
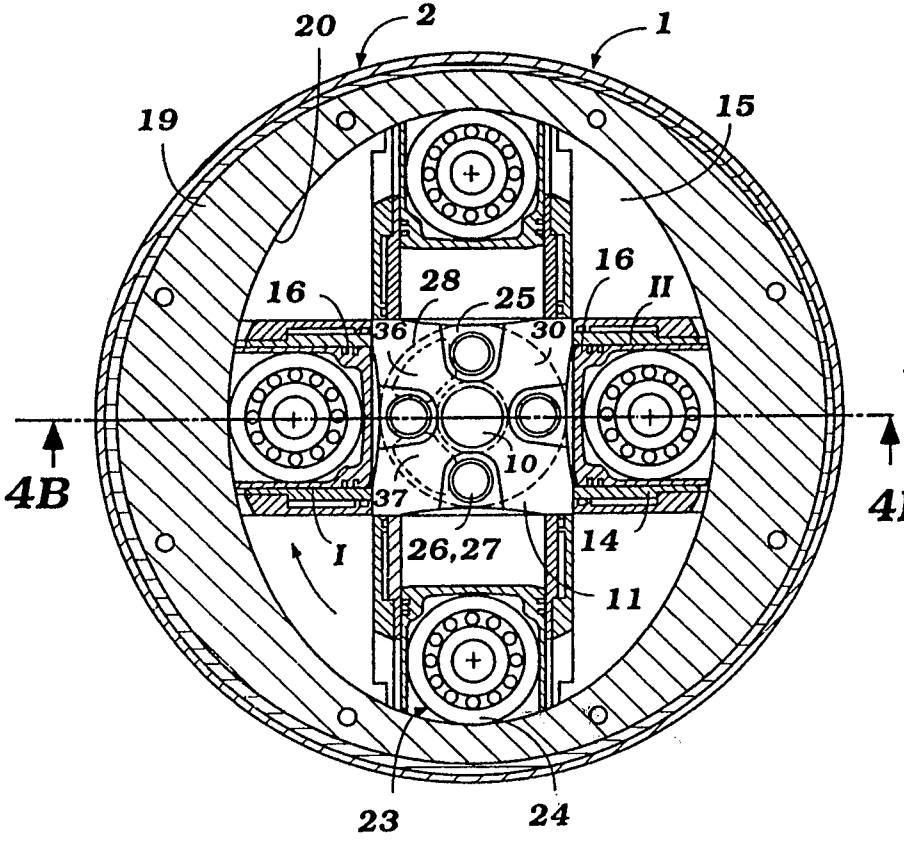

In FIGS. 4A and 4B piston I is in position to begin the suction/intake of the fuel-air mixture while piston II is in position to ignite the compressed fuel-air mixture.

Figure 5B:
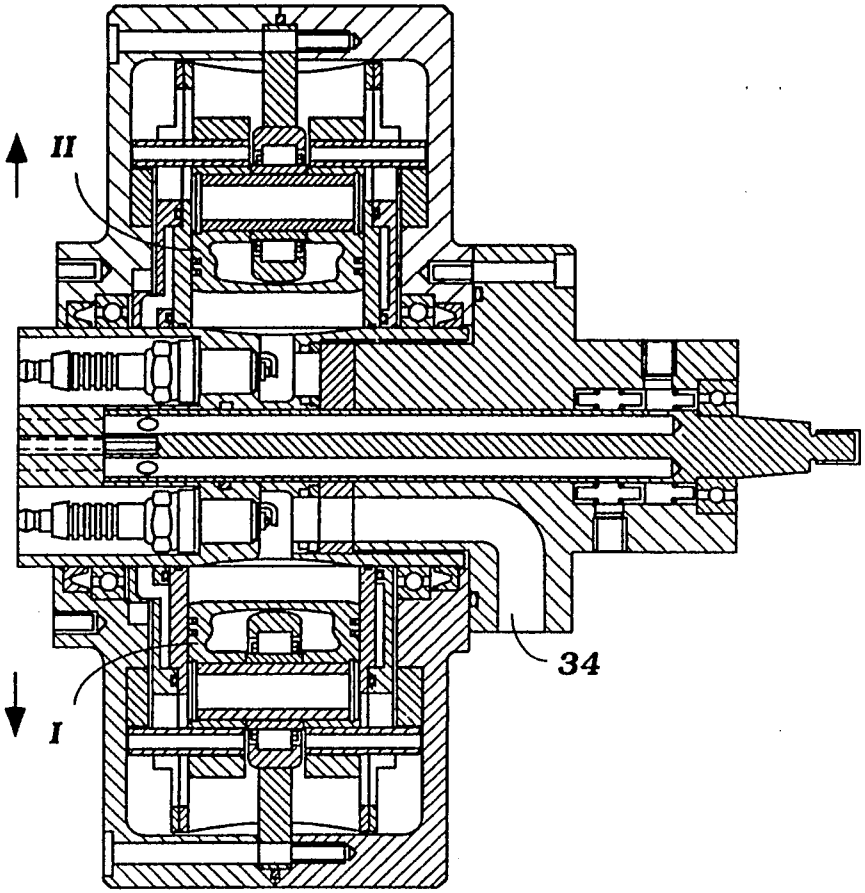
Figure 5A:
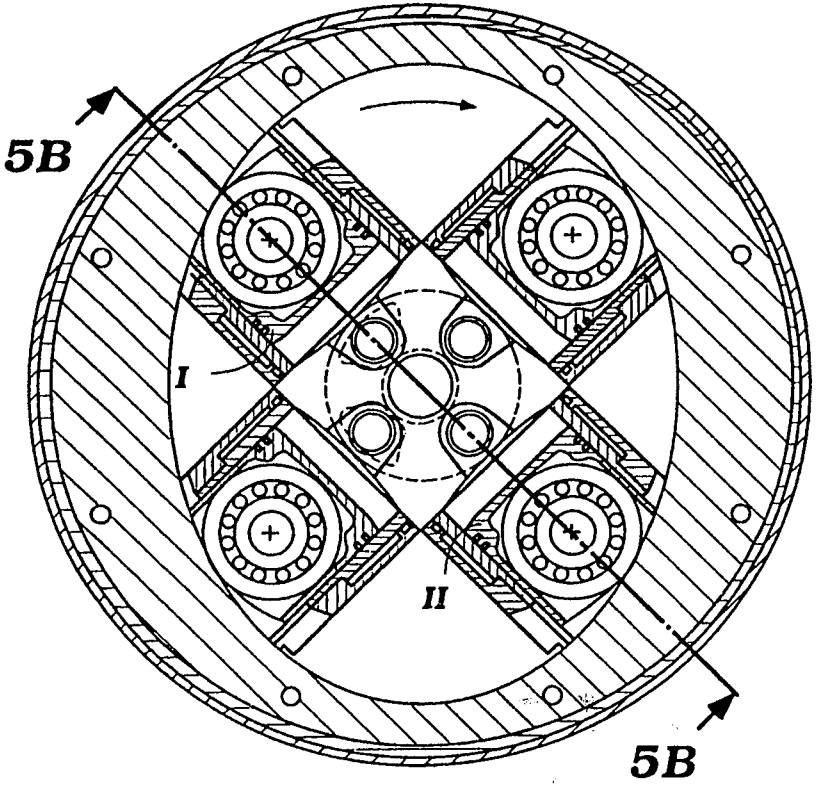

FIGS. 5A and 5B show the suction phase (suction stroke) of piston I and the expansion phase (working stroke) of piston II.

Figure 6B:
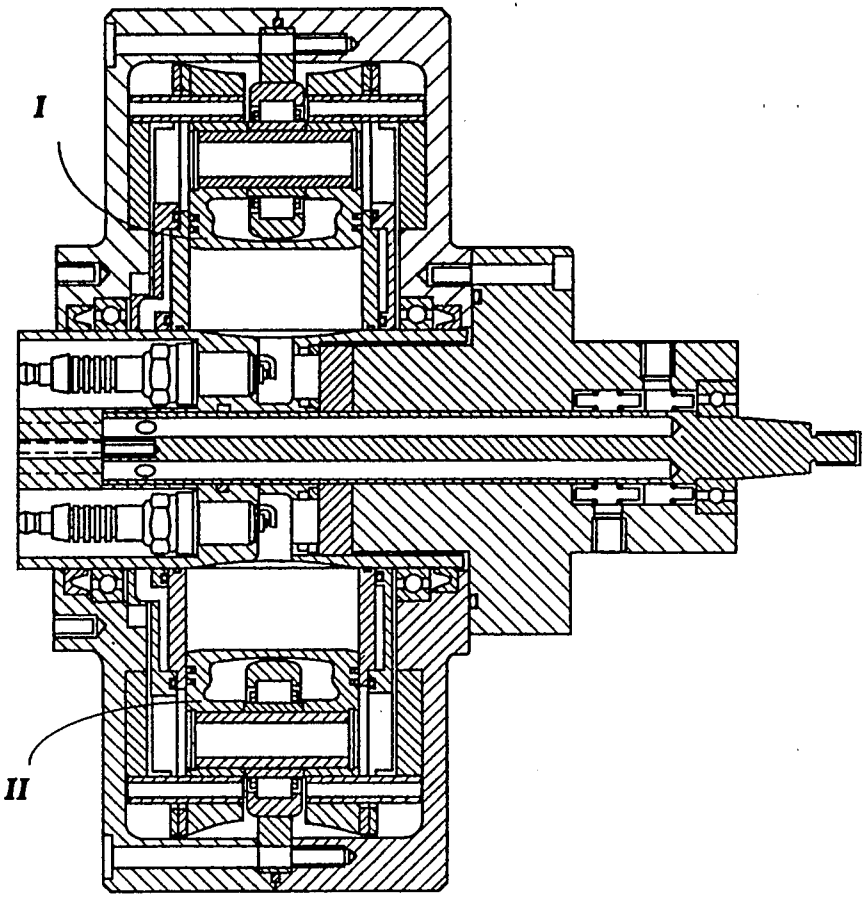
Figure 6A:
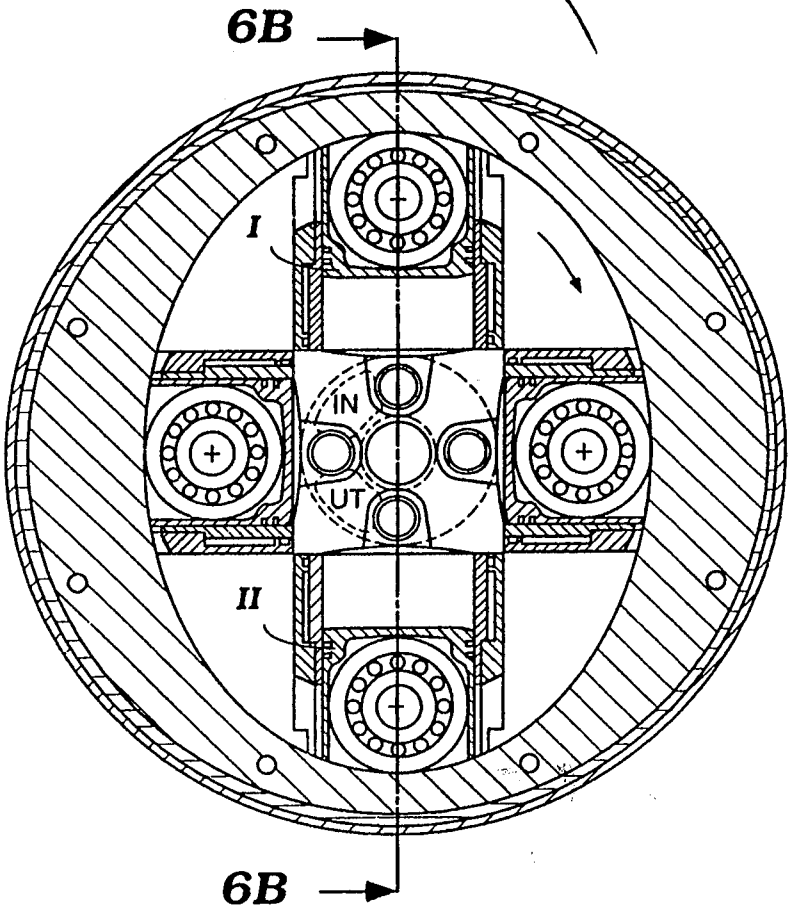

In FIGS. 6A and 6B piston I is about to begin the compression and piston II is about to begin the exhaust stroke.

Figure 7A:
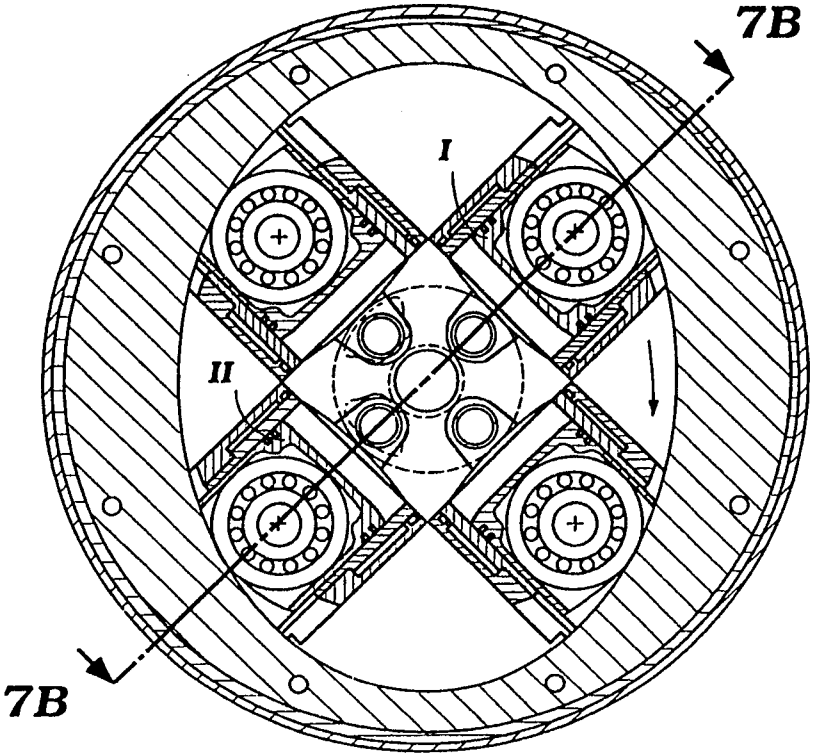

FIGS. 7A and 7B, finally, show piston I in the compression phase (compression stroke) and piston II in the exhaustion phase (exhaust stroke).

All four pistons 16 sequentially travel through all four strokes or cycles during one revolution of the rotary unit 10, 11, 14, and 16.

It goes without saying that the invention should not be regarded as limited to the embodiment described herein and illustrated in the drawings, which embodiment is the one preferred at the moment, but that the invention could be modified in a variety of ways within the scope of the appended claims.

I claim:

1. A four-stroke, radial-piston engine, comprising a stationary housing (2), a drive shaft (10) which is rotationally mounted substantially centrally inside said housing and which supports a hub (11) rotating therewith, at least two radially projecting cylinders (14) which are mounted on the hub to rotate therewith, said cylinders being positioned inside a circumferentially extending chamber (15) in said housing (2) and each having a piston which is mounted for radial reciprocating movement inside its associated cylinder, the piston heads (17) of said pistons facing radially inwards towards the hub (11), a circumferentially extending cam member (19) mounted inside the housing (2) in alignment with the pistons (16) adjacent the radially outwardly extending piston ends (21) and having a cam face facing said pistons, against which cam face abut bearing means (23) mounted on each piston (16) in order to impart a radial movement to said pistons in the direction towards the hub upon rotation of the rotary unit formed by the pistons (16), the cylinders (14), the hub (11), and the drive shaft (10) relatively to the stationary housing (2), and a combustion chamber (25) formed in said hub (11) essentially in alignment with the head (17) of each one of said pistons (16), which combustion chamber has valve-operated inlets and outlets (26, 27) for intake and exhaustion, respectively, of a combustible fuel-air mixture and combusted exhaust gases, whereby said pistons (16) are imparted a radial movement away from the hub (11) in response to the compression-induced increase of pressure and the centrifugal force, characterized in that the inlets and outlets (26, 27) to and from, respectively, each combustion chamber (25) are common and are formed in a valve ring (28) which rotates together with the hub (11) and which is essentially concentric therewith, said valve ring sealingly abutting against a stationary port ring (30) which is essentially concentric with the valve ring and which is connected to the housing (2), said port ring being formed with axial intake and exhaust ports (36, 37) communicating with inlet and outlet ducts (34, 35), said axial intake and exhaust ports alternatingly assuming, upon rotation of said rotary unit (10, 11, 14, 16) respectively to the housing (2), a position in alignment with that inlet and outlet (26, 27) formed in the valve ring (28) that is associated with the respective combustion chamber (25), and in that one spark plug (46) is provided for each combustion chamber (25), said spark plugs being screwed essentially axially into the hub (11) and rotating together with the latter, so that by means of their electrode ends the spark plugs project into their associated one of the combustion chambers essentially in alignment with the common inlet and outlet (26, 27) in the valve ring (28).

2. An engine as claimed in claim 1, characterized in that the valve ring (28) is yieldingly pressed into abutment against the port ring (30) and supports sealing rings (31) around its inlets and outlets (26, 27).

3. An engine as claimed in claim 1, characterized in that the inlets and outlets (26, 27) in the valve ring (28) are axially prolonged in the form of sleeves (32) extending away from the valve ring, which sleeves (32) project into corresponding recesses (33) formed in the hub (11) to ensure securement and displacement of the valve ring, said sleeves also supporting the sealing rings (31).

4. An engine as claimed in claim 1, characterized in that the conductive end of the respective spark plug (46) is connected to an ignition distributor (47), the electrodes (49) of said plugs being arranged to rotate together with the rotary unit (10, 11, 14, 16), said electrodes abutting against one connective spark plug end each and being arranged to sequentially move past a stationary electrode (51) which in turn is connected to an ignition source of current.

5. An engine as claimed in claim 4, characterized in that the rotating electrodes (49) are mounted in recesses (52) formed in a retainer (53) secured on the drive shaft (10), and in that the stationary electrode (51) is mounted on an attachment means (55) secured on the stationary housing (2).

6. An engine as claimed in claim 4, characterized in that the rotating electrodes (49) are urged against the connective ends of the spark plugs (46) by means of springs (48).

7. An engine as claimed in claim 1, characterized in that the inlet and outlet ducts (34, 35) are formed in a connecting collar (8) mounted on the housing (2), said ducts debouching at one of their ends at a point axially opposite the intake and exhaust ports (36, 37) in the port ring (30) while at their opposite end the ducts are connected respectively to a carburetter (38) or an injection system and to an exhaust system (39).

8. An engine as claimed in claim 7, characterized in that an inlet pipe (40) is inserted between the opposite end of the inlet duct (34) and the carburetter (38) or the injection system, into which inlet pipe opens a channel (41) communicating with the circumferentially extending chamber (15) of the housing in order to reduce the chamber pressure to a negative pressure and thus remove by-pass gases by suction and, at least at low rotational speeds of the engine, facilitate the radial movement outwards of the pistons (16).

9. An engine as claimed in claim 1, characterized in that at least one circumferentially extending returning cam member (56) is mounted in the stationary housing (2) and has a radially outwardly facing cam face (57) of essentially equal configuration to that of the cam face (20) of the cam member (19), and that at least one return pin (58) fitted on each piston (16) is arranged to be moved into abutment against the cam face (57) of the return cam member (58) in order to force the pistons (16) radially outwards, at least when the engine is started and/or when the rotational speed of the engine is low.

10. An engine as claimed in claim 9, characterized by two return cam members (56), one on either side of the pistons (16) and radially interiorly of the cam member (19), and by two return pins (58) projecting in opposite axial directions on each piston (16), whereby the pistons are forced to move radially outwards while being prevented from assuming an oblique position inside their associated one of the cylinders (14).

* * * * *

UNITED STATES PATENT AND TRADEMARK OFFICE

CERTIFICATE OF CORRECTION

PATENT NO. : 5,357,911

DATED : October 25, 1994

INVENTOR(S) : Karl-Erik Lindblad

It is certified that error appears in the above-identified patent and that said Letters Patent is hereby corrected as shown below:

ON THE TITLE PAGE, in the U.S. PATENT DOCUMENTS, Item [56], "5,023,536" should be — 4,023,536 —.

ON THE TITLE PAGE, in the ABSTRACT, Item [57], line 4, "providing" should be — provided —.

Column 1, line 14, "piston" should be — pistons —.

Column 1, line 24, after "housing," insert — and —.

Column 2, line 29, "plug" should be — plugs —.

Column 2, line 62, "ports" should be — parts —.

Column 6, line 33, Claim 1, "respectively" should be — relatively —.

Column 6, line 56, Claim 4, "conductive" should be — connective —.

Column 8, line 4, Claim 9, "returning" should be — return —.

Signed and Sealed this

Fourth Day of April, 1995

*Attest:*

*Attesting Officer*

Bruce Lehman

BRUCE LEHMAN

*Commissioner of Patents and Trademarks*